US005565638A

United States Patent [19]

Liao

[11] Patent Number: 5,565,638

[45] Date of Patent: Oct. 15, 1996

[54] MUSICAL INSTRUMENT PEDAL

[76] Inventor: Tsun-Chi Liao, No. 14, Chun-Kung Rd., Taichung, Taiwan

[21] Appl. No.: 606,443

[22] Filed: Feb. 23, 1996

[51] Int. Cl.[6] ..... G10D 13/02

[52] U.S. Cl. ..... 84/422.1

[58] Field of Search ..... 84/422.1, 422.2, 84/422.3

[56] References Cited

U.S. PATENT DOCUMENTS 5,431,081 7/1995 Lombardi et al. ..... 84/422.1
5,458,038 10/1995 Kurosaki ..... 84/422.1

*Primary Examiner*—Patrick J. Stanzione
*Attorney, Agent, or Firm*—Bacon & Thomas

[57] ABSTRACT

A musical instrument pedal including a front pedal plate and a rear pedal plate pivoted to the front pedal plate wherein the front pedal plate has an axle housing defining a hexagonal through hole and having two bottom screw holes in communication with the hexagonal through hole; the rear pedal plate has two lugs, which hold a respective axle bearing, and a front receiving space defined between the lugs; a hexagonal pivot axle is fitted into the hexagonal through hole of the axle housing, having two round pins at two opposite ends respectively supported on the axle bearings of the lugs; two tightening up screws are respectively threaded into the bottom screw holes of the axle housing to hold down the pivot axle.

4 Claims, 5 Drawing Sheets

MUSICAL INSTRUMENT PEDAL

BACKGROUND OF THE INVENTION

The present invention relates to musical instrument pedals, and relates more particularly to such a musical instrument pedal which is comprised of a front pedal plate and a rear pedal plate pivotably connected together by a pivot axle, which is supported on the rear pedal plate by axle bearings and fixedly secured to an axle housing at the rear end of the front pedal plate by tightening up screws.

A regular percussion instrument pedal, as shown in FIG. 1, is generally comprised of a front pedal plate pivoted to an element of the percussion instrument and having a rear connecting block with a pivot hole, and a rear pedal plate having two lugs respectively connected to two opposite ends of the pivot hole of the rear connecting block by a round pivot. When the rear connecting block of the front pedal plate is pivotably connected between the lugs of the rear pedal plate, a gap is left between the rear connecting block and each of the lugs of the rear pedal plate. Therefore, when the percussion instrument pedal is operated, the front pedal plate tends to displace along the round pivot, thereby causing the rear connecting block to rub against the lug and to cause noise.

SUMMARY OF THE INVENTION

It is one object of the present invention to provide a musical instrument pedal which is stable in use. It is another object of the present invention to provide a musical instrument pedal which does not cause noise during its operation. To achieve these and other objects of the present invention, there is provided a musical instrument pedal which comprises a front pedal plate having an axle housing at the rear end, which defines a hexagonal through hole and has two bottom screw holes in communication with the hexagonal through hole, a rear pedal plate having two lugs which hold a respective axle bearing, a hexagonal pivot axle fitted into the hexagonal through hole of the axle housing and having two round pins at two opposite ends respectively supported on the axle bearings of the lugs, and two tightening up screws respectively threaded into the bottom screw holes of the axle housing to hold down the pivot axle.

DETAILED DESCRIPTION OF THE PREFERRED EMBODIMENT

Figure 1:
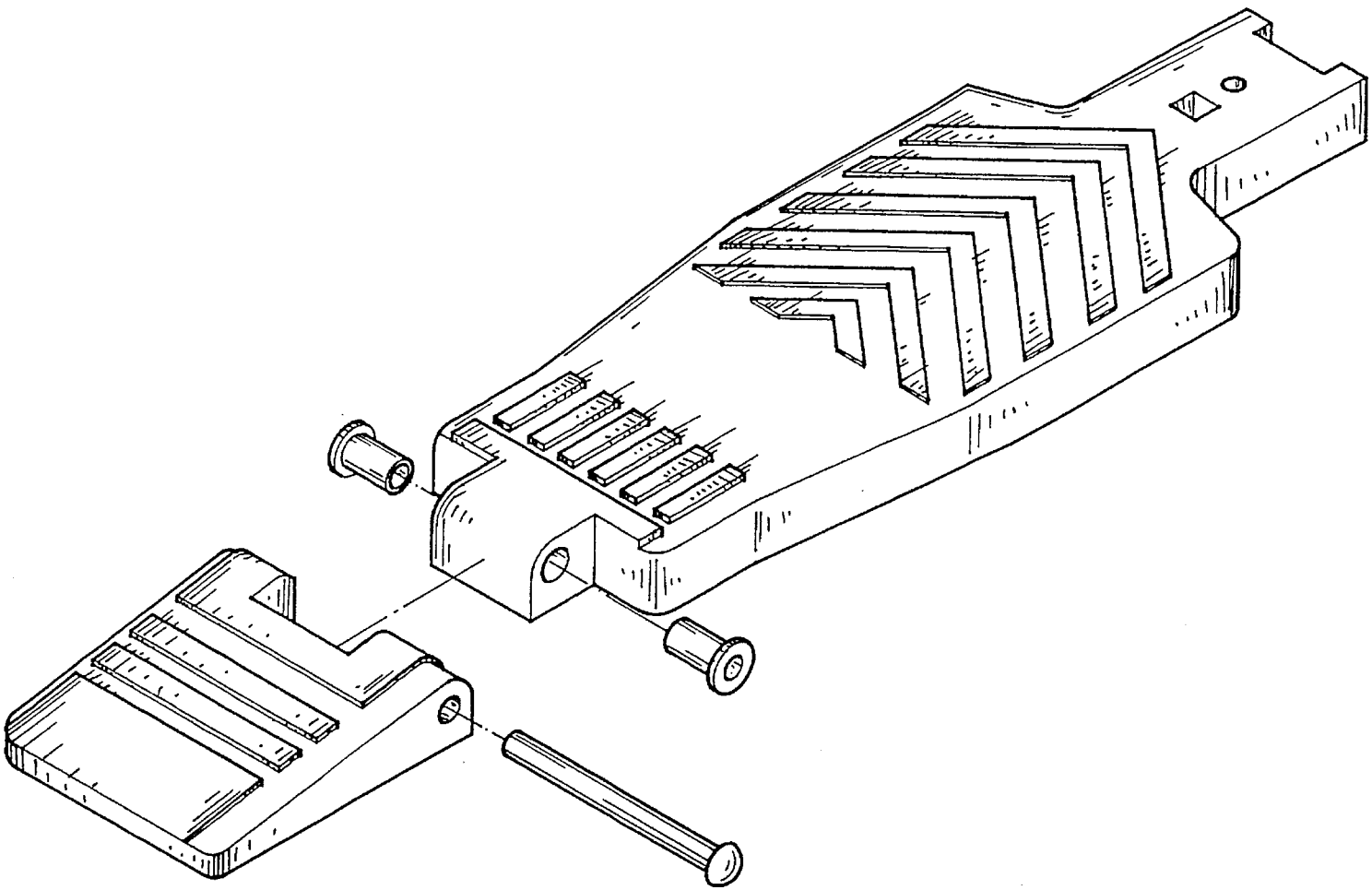
Fig. 1 PRIOR ART
FIG. 1 is an exploded view of a percussion instrument pedal according to the prior art.
Figure 2:
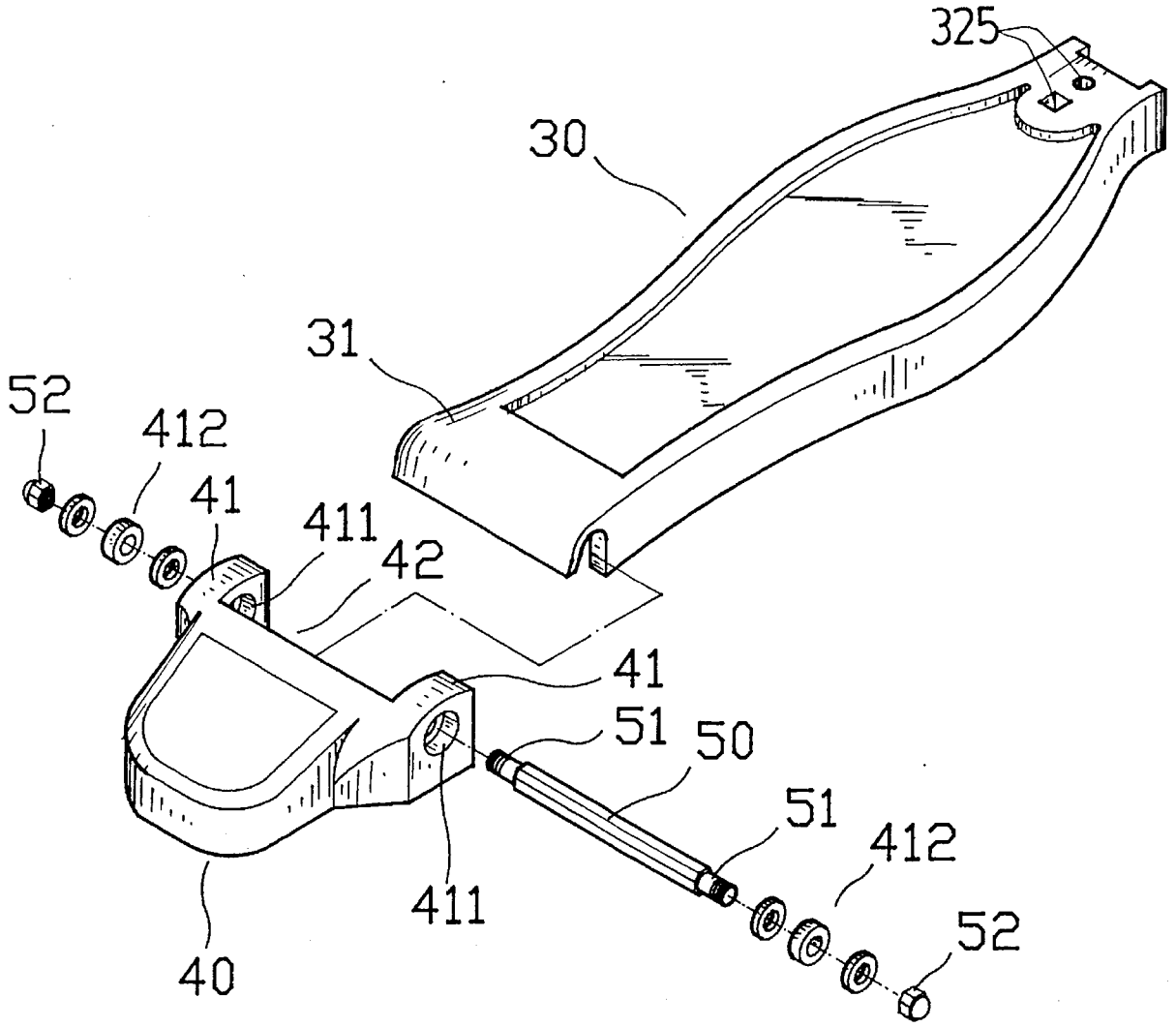
FIG. 2 is an exploded view of a musical instrument pedal according to the present invention.
Figure 3:
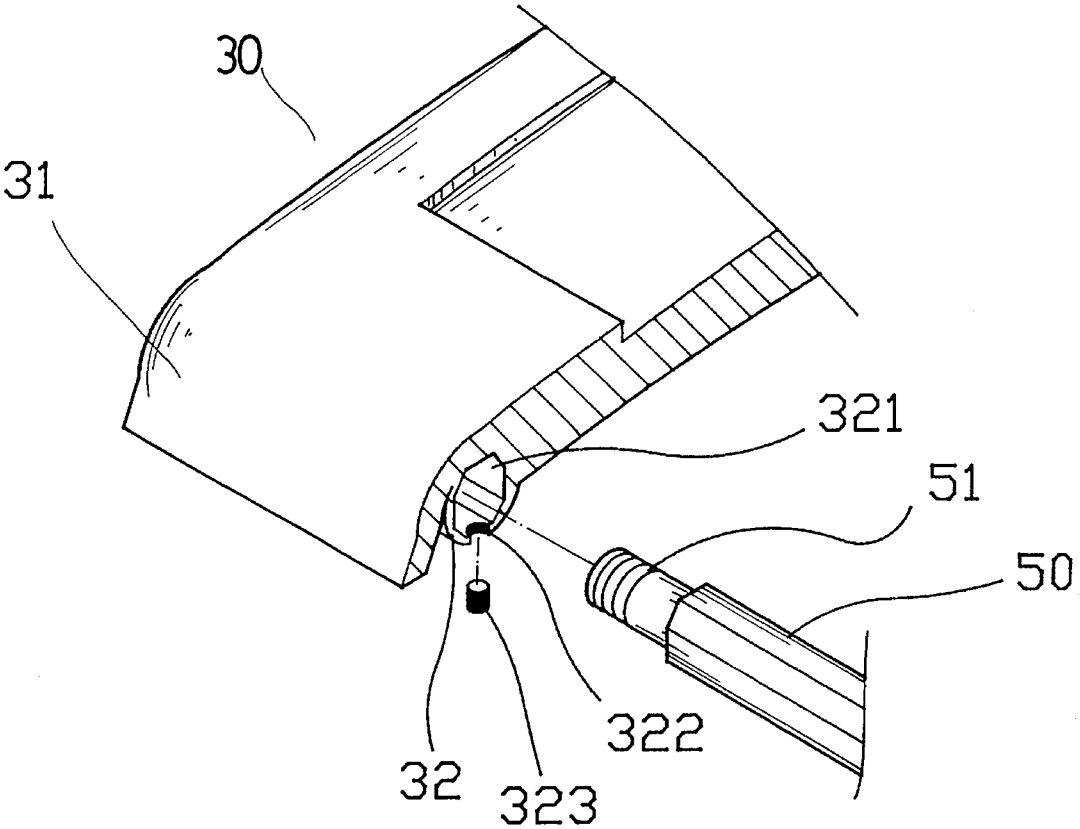
FIG. 3 is a cutaway of the front pedal plate of the musical instrument pedal shown in FIG. 2.
Figure 4:
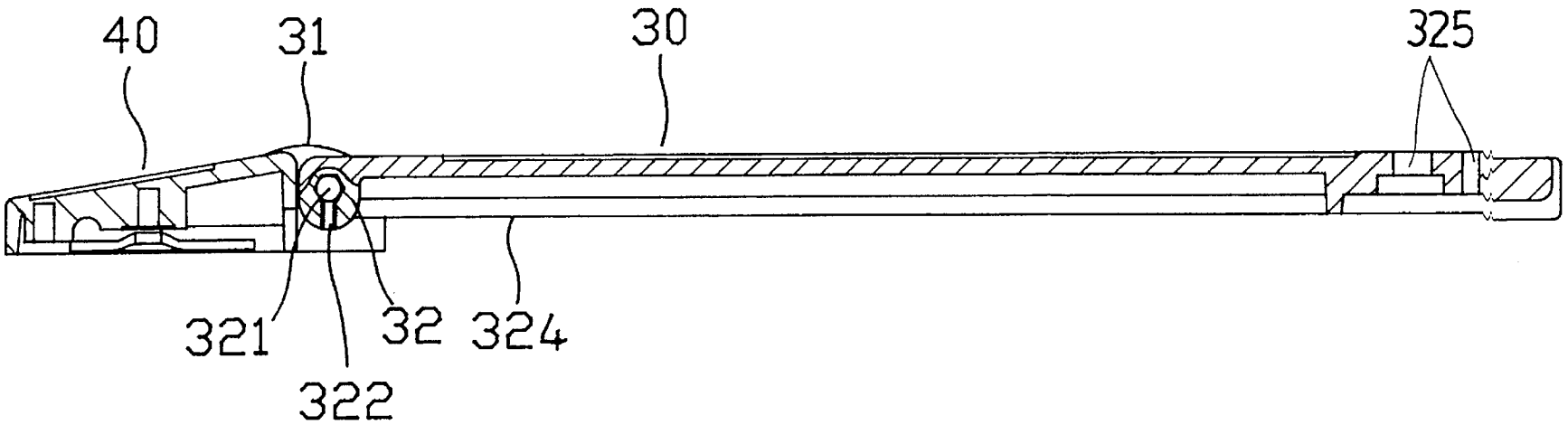
FIG. 4 is a longitudinal view in section of the musical instrument pedal shown in FIG. 2.
Figure 5:
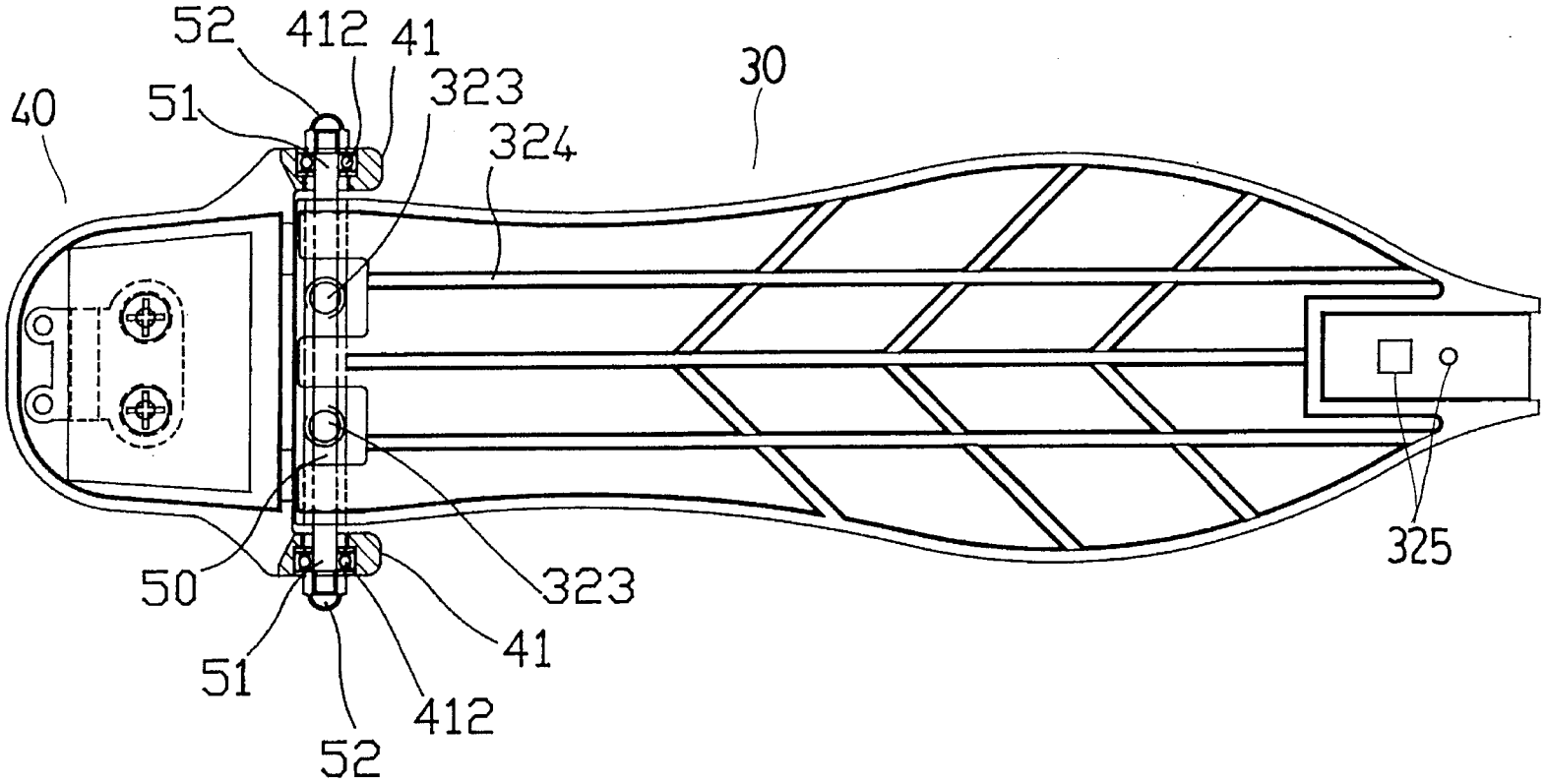
FIG. 5 is a bottom view of the musical instrument pedal shown in FIG. 2.

Referring to Figures from 2 to 5, a musical instrument pedal in accordance with the present invention is generally comprised of a front pedal plate 30 and a rear pedal plate 40. The front pedal plate 30 has a rear end terminating in an arched flange 31, a transverse axle housing 32 integrally made on the inside near the arched flange 31 and defining a polygonal through hole for example hexagonal through hole 321 through the length, two bottom screw holes 322 respectively disposed at the bottom of the axle housing 32 and perpendicularly communicating with the hexagonal through hole 321, a plurality of reinforcing ribs 324 raised from the bottom side, and a plurality of mounting holes 325 at the front end for fastening to the musical instrument (not shown). The rear pedal plate 40 has two lugs 41 forwardly raised from two opposite ends of the front side, and a receiving space 42 defined between the lugs 41. Each of the lugs 41 has a bearing hole 411, which receives an axle bearing 412.

When the front pedal plate 30 is inserted into the receiving space 42 of the rear pedal plate 40 with the axle housing 32 set into alignment with the axle bearings 412 of the lugs 41, a pivot axle 50 is inserted through the hexagonal through hole 321 of the axle housing 32 and connected to the axle bearings 412 in the bearing holes 411 of the lugs 41 by cap nuts 52, and then two tightening up elements for example tightening up screws 323 are respectively threaded into the bottom screw holes 322 of the axle housing 32 to hold down the pivot axle 50. The cross section of the pivot axle 50 fits the hexagonal through hole 321 of the axle housing 32, having two threaded round pins 51 at two opposite ends respectively inserted through the axle bearings 412 and then respectively fastened with the cap nuts 52. When assembled, the arched flange 31 covers over the receiving space 42 to protect the axle housing 32.

When the front pedal plate 30 is depressed, the pivot axle 50 is moved with the front pedal plate 30. Because the pivot axle 50 is supported on the lugs 41 of the rear pedal plate 40 by the axle bearings 412, it can be turned with the front pedal plate 30 relative to the rear pedal plate 40. Because the tightening up screws 323 are respectively threaded into the bottom screw holes 322 of the axle housing 32 to hold down the pivot axle 50, the front pedal plate 30 does not oscillate relative to the pivot axle 50 when it is operated.

I claim:

1. A musical instrument pedal of the type comprising a front pedal plate having a front end connected to a musical instrument and a rear end fixedly made with a transverse axle housing, and a rear pedal plate having two front lugs pivotably connected to two opposite ends of said transverse axle housing by a pivot axle and a front receiving space defined between said two front lugs, wherein said axle housing comprises a polygonal through hole aligned between said front lugs for the passing of said pivot axle, and has two bottom screw holes perpendicularly communicating with said polygonal through hole; said front lugs comprise a respective bearing hole and a respective axle bearing mounted within the respective bearing hole; said pivot axle is inserted through the polygonal through hole of said axle housing, having a cross section fitting said polygonal through hole, and two threaded round pins at two opposite ends respectively inserted through the axle bearings of said lugs and fastened up with a respective cap nut; two tightening up elements are respectively fastened to the bottom screw holes of said axle housing to hold down said pivot axle.

2. The musical instrument pedal of claim 1 wherein said front pedal plate has an arched flange raised from the rear end and covered over the front receiving space of said rear pedal plate to protect said axle housing.

3. The musical instrument pedal of claim 1 wherein the polygonal through hole of said axle housing is a hexagonal through hole.

4. The musical instrument pedal of claim 1 wherein said tightening up elements are tightening up screws.

* * * * *